United States Patent [19]

Schmoll, III

[11] 4,300,435

[45] Nov. 17, 1981

[54] SYNTHESIZER FOR ORGAN VOICES

[75] Inventor: George F. Schmoll, III, Dolton, Ill.

[73] Assignee: CBS Inc., New York, N.Y.

[21] Appl. No.: 209,438

[22] Filed: Nov. 24, 1980

Related U.S. Application Data

[63] Continuation of Ser. No. 72,969, Sep. 6, 1979, abandoned.

[51] Int. Cl.[3] ..... G10H 1/02

[52] U.S. Cl. ..... 84/1.19; 84/DIG. 9; 84/1.11

[58] Field of Search ..... 84/1.01, 1.11, 1.19, 84/DIG. 9

[56] References Cited

U.S. PATENT DOCUMENTS

| | | | |
|---|---|---|---|
| 3,852,640 | 12/1974 | McCarthy | 315/276 D |
| 3,974,461 | 8/1976 | Luce | 84/DIG. 9 |
| 4,106,384 | 8/1978 | Whittington et al. | 84/DIG. 9 |
| 4,110,750 | 8/1978 | Heyning et al. | 84/1.01 |
| 4,173,915 | 11/1979 | Gross | 84/1.19 |
| 4,185,531 | 1/1980 | Oberheim et al. | 84/1.11 |
| 4,203,339 | 5/1980 | Welsh et al. | 84/1.19 |
| 4,210,054 | 7/1980 | Howell et al. | 84/1.19 |
| 4,236,437 | 12/1980 | Howell et al. | 84/1.19 |

*Primary Examiner*—Gene Z. Rubinson
*Assistant Examiner*—Forester W. Isen
*Attorney, Agent, or Firm*—Spencer E. Olson

[57] ABSTRACT

In an electronic musical instrument, such as an electronic organ, certain organ voices are synthesized by applying a tone signal to a voltage controlled low-pass sharp cutoff filter, the pass characteristic of which has a relatively sharp knee and a rapid rate of rolloff, thereby to sharply attenuate the harmonics contained in the tone signal which have frequencies above the cutoff frequency. The filter works on the principle that by switching one or more frequency-determining resistors in and out of the filter network at a rapid rate and varying the time on versus the time off, the effective value of the resistance varies to thereby alter the cutoff frequency and the character of the resulting sound signal. In accordance with the present invention, precise control over the switching duty cycle is achieved by establishing a reference voltage to which is added a voltage increment according to a binary weighting determined by selection of a particular organ voice. The sum of these voltages is compared with a sawtooth voltage in a comparator to produce a rectangular pulse the width of which is a function of the intersection of the ramp voltage with the sum voltage. By varying the sum voltage in digital increments in accordance with a selected voice, the width of the pulses is varied and these pulses, which are supplied to the filter, thus vary the filter characteristic to produce a sound signal simulative of the selected voice.

8 Claims, 3 Drawing Figures

SYNTHESIZER FOR ORGAN VOICES

This application is a continuation of application Ser. No. 72,969, filed Sept. 6, 1979, now abandoned.

BACKGROUND OF THE INVENTION

This invention relates generally to electrical musical instruments, and more particularly to a synthesizer for producing tonal effects highly imitative of the speech characteristics of certain reed organ pipes.

One known system for producing tonal effects imitative of the speech characteristics of reed organ pipes is described in Peterson U.S. Pat. No. 4,023,455 and utilized by applicant's assignee in some of its organ models. It produces sound signals simulative of the Waldhorn, Fagot, Trompette, and Post Horn, for example, by applying a train of electrical pulses to a low pass filter having a sharp knee and a very rapid rate of rolloff above the cutoff frequency, the object being that as the frequency of the harmonics of the pulse signal increases, the amplitude of the output signal from the filter remains essentially constant up to the cutoff frequency and thereafter essentially immediately drops for frequencies above the cutoff frequency. The cutoff frequency of the filter is controllable over a range from approximately 2.0 KHz. to 8.0 KHz., the selected cutoff frequency determining the tonal quality of a given organ voice. For example, if a control voltage is set to give the filter a cutoff frequency of approximately 2.0 KHz., the reproduced output signal from the filter sounds very much like an organ Waldhorn, which is a very mellow reed stop similar to the orchestral French Horn. If the control voltage is changed to raise the filter cutoff frequency to approximately 2.8 KHz., more harmonics of the applied signal pass through the filter and the resulting output signal has a tone quality characteristic of the Fagot. As the cutoff frequency is further increased, by even slight amounts, sounds of a strikingly different character are produced as additional high order harmonics are allowed to pass through the filter.

In the Peterson system the cutoff frequency of the filter is varied between predetermined limits by varying the effective resistance of the frequency-determining resistors by connecting light dependent resistors (LDR's) in parallel with the frequency-determing resistors, and varying the intensity of light illuminating the LDR's. The lamp and the LDR's are enclosed in a light-tight container and the intensity of the lamp is varied in accordance with a DC control voltage thereby to adjust and vary the cutoff frequency of the filter. Peterson discloses the use of an incandescent lamp to illuminate the LDR's, and it is also known to use an LED instead of an incandescent lamp, but experience has shown that whichever source of illumination is utilized, this technique for controlling the cutoff characteristics of a filter has shortcomings which make it only marginally effective, in situations such as this, where precise control of cutoff frequency is essential to production of the desired organ voice. For example, because of the practical difficulty of positioning the lamp with respect to the LDR's so as to equally illuminate all of the LDR's (usually four in a package), it is necessary to provide adjustable resistors to balance the resistance values of the LDR's which, in turn, necessitates time-consuming factory adjustments to establish the upper and lower limits of the range of cutoff frequencies, and introduce the risk of inadvertent disturbance of the factory adjustment by a salesman or customer, with the consequence that the resulting organ voice does not correspond to the one selected.

Another disadvantage of the combination of an incandescent lamp and a plurality of LDR's for controlling the characteristics of a filter is that the lamp brightness slightly "lags" both the application of current to the filament and removal of current from the filament. That is, the lamp does not reach full brightness immediately upon application of the control voltage, nor does the illumination abruptly go to zero upon removal of lamp voltage; this leads to a lack of precise timing and control. Moreover, the brightness of the filament of an incandescent lamp decreases with continued use, with the consequence that control of the filter characteristics may deteriorate with time.

SUMMARY OF THE INVENTION

It is accordingly the object of this invention to provide, in an electronic musical instrument, an improved system for simulating certain organ voices that avoids the limitations of the described prior art system and gives more precise control over the cutoff frequency of the fiter with resulting improvement in the tonal quality of the sound signals produced at the output of the filter.

According to one embodiment of this invention, tone signals are applied to a voltage controlled sharp cutoff, low-pass filter circuit having a cutoff frequency which is controllable over a predetermined range in response to variations in the duty cycle of a sequence of pulse width modulated pulses, and having a rapid rate of rolloff above the cutoff frequency. Precise control of the cutoff frequency is achieved by varying the effective resistance of the frequency-determining resistors by switching one or more of such resistors in and out of the circuit at a rapid rate and varying the time on versus the time off, thereby to vary their effective resistances. The width of the pulses applied to the filter is controlled by establishing a reference voltage to which is added a voltage increment according to a binary weighting determined by selection by the player of a particular organ voice. The sum of the discrete voltage level corresponding to an organ voice defined by binary encoded information and the reference voltage is compared with a sawtooth voltage in a comparator to produce a rectangular pulse the width of which is a function of the intersection of the ramp voltage with the sum voltage. By varying the sum voltage in digital increments in accordance with a selected voice, the width of the pulses is varied and these pulses, which are supplied to the filter, precisely control the cutoff frequency of the filter to produce a sound signal highly imitative of the selected voice.

In a preferred embodiment, the system is arranged to separately produce sound signals simulative of a Post Horn, a trumpet, a trombone and a French horn, and by selection by the player of combinations of two or more of these voices it is possible to obtain additional voices, each of distinctive tonal quality.

BRIEF DESCRIPTION OF THE DRAWINGS

Other objects and features of the invention will become apparent, and its construction and operation better understood, from the following detailed description, taken in conjunction with the accompanying drawings, in which.

DESCRIPTION OF THE PREFERRED EMBODIMENT

Figure 1:
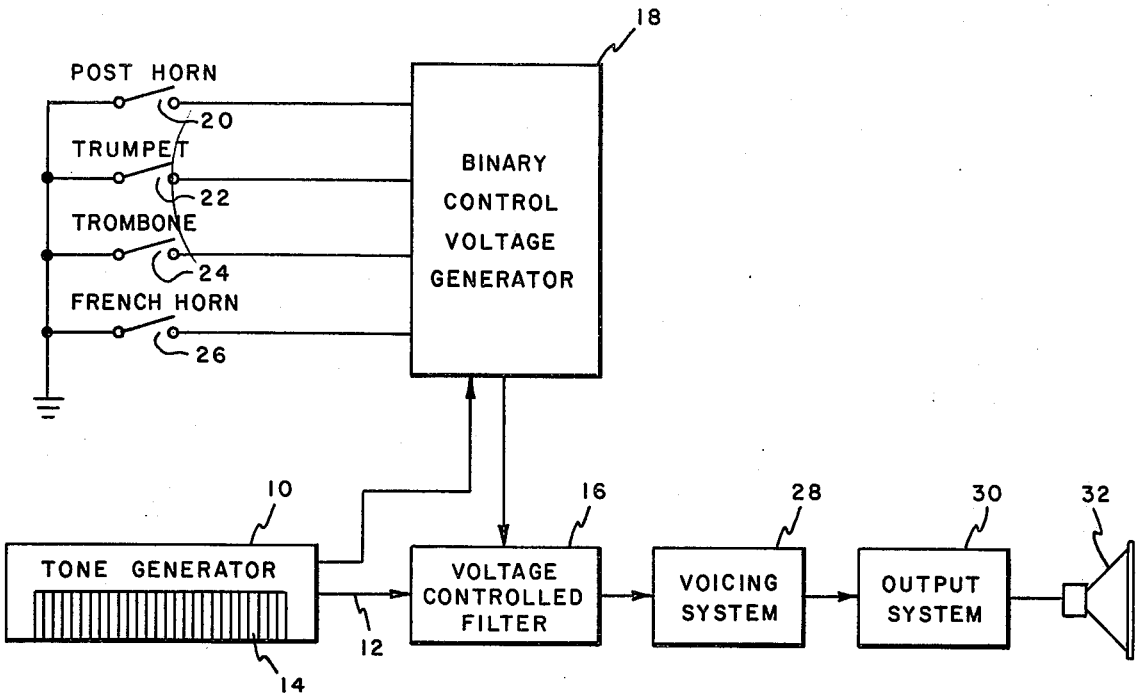
FIG. 1 is a block diagram showing incorporation of the present invention in an electronic organ system.

Referring to FIG. 1, the present invention has application in an electronic organ system consisting of a tone signal generator 10 having a terminal 12 for delivering tone signals selected by the player by means of the keys of an organ or of one manual of a multi-manual organ. The tone signals are applied to a voltage controlled low pass filter 16, the pass characteristic of which has a relatively sharp knee and a rapid rate of rolloff. The cutoff frequency of the filter is controllable in response to variations in the duty cycle of a sequence of pulse width modulated pulses produced by a binary control voltage generator 18. The width of the pulses supplied to the filter is determined by the closure of one or more of four switches 20, 22, 24 and 26 labelled "Post Horn", "Trumpet", "Trombone" and "French Horn", respectively, each switch or combination of switches defining in binary encoded form information uniquely identifying a different one of a plurality of organ voices. The signals from the output of filter 16 are applied to a voicing system 28 the output signal from which is applied to the output system 30 of the organ for reproduction by a loudspeaker 32.

Figure 2:
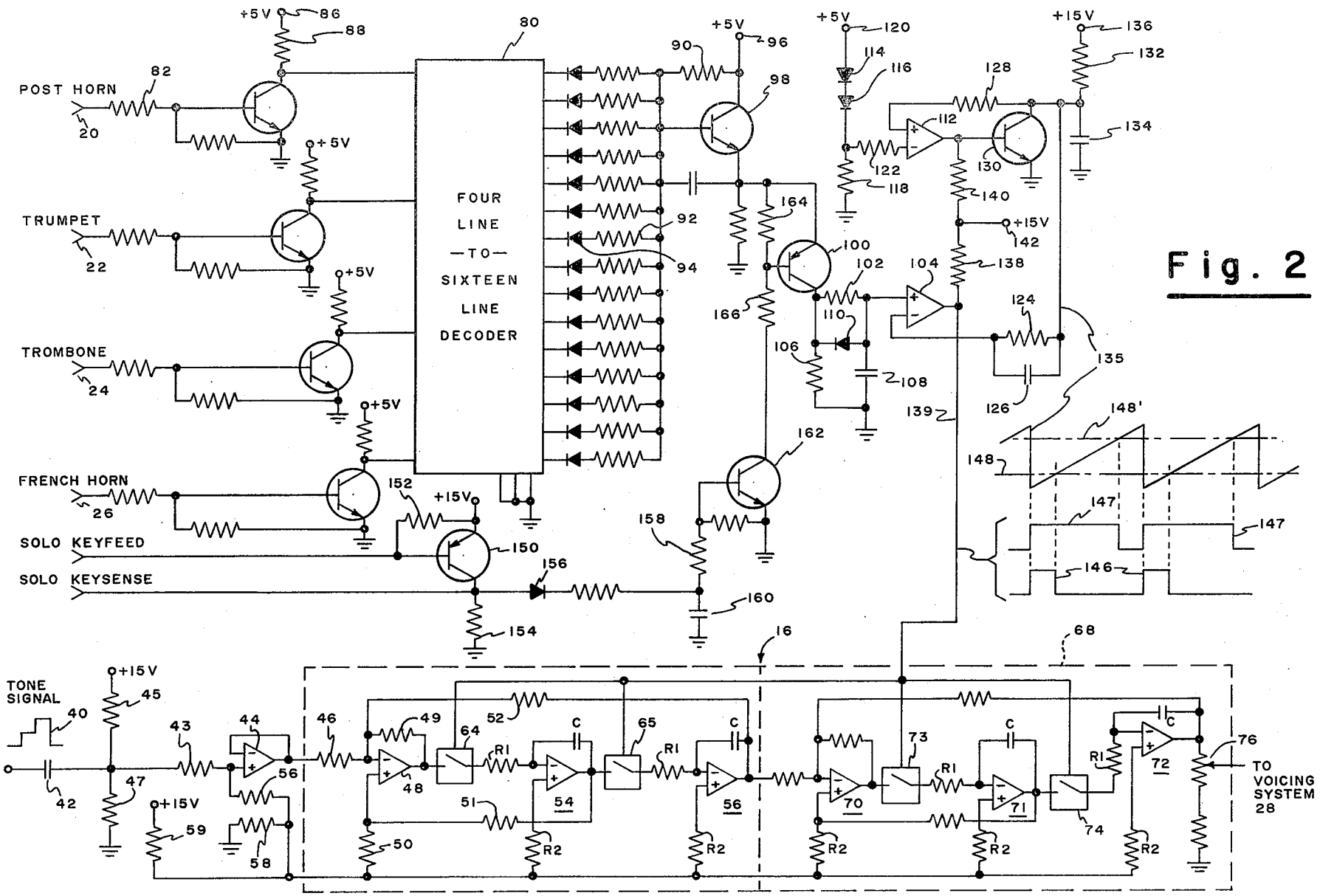
FIG. 2 is a schematic circuit diagram of a voltage controlled filter according to the invention.

Referring now to FIG. 2, the system utilizes as a primary source of tone signals a tone-generating system for producing signals of square waveform having fundamental frequencies corresponding to the notes of a musical scale. These square wave signals are initially converted by summing in the known two-to-one ratio in a resistor network a 16-foot square wave signal and an 8-foot square wave signal to produce the "stairstepped" signal 40, which contains both even and odd harmonics. The tone signal is coupled via a capacitor 42 and a resistor 43 to the non-inverting input of an operational amplifier 44 which serves to harden the signal before application to the filter, which is designed to operate only from a low impedance input. The junction of capacitor 42 and resistor 43 is connected to a +15 volts potential source via a resistor 45, and to audio ground via a resistor 47. The non-inverting input of amplifier 44 is connected to audio ground via resistors 56 and 58, and the junction of resistors 56 and 58 is connected via a resistor 59 to a +15 volts potential source.

The filter is of the state-variable type, described for example in *Active-Filter Cookbook* by Don Lancaster, pp 129–134, published in the United States in 1975 by Howard W. Sams & Co., Inc., Indianapolis, Ind., which consists of two integrators connected in a loop with a summing input network. More particularly, the filter comprises an operational amplifier 48, which serves as the summing input network, and to the inverting input of which the output of amplifier 44 is applied via a resistor 46. The output of amplifier 48 is connected to its inverting input via a resistor 49 having the same resistance value as resistor 46, typically 10 Kohms, and the non-inverting input is connected to the junction of resistors 56, 58 and 59 via a resistor 50. The two integrators, shown at 54 and 56, each consists of an operational amplifier having a capacitor C connected between its output and its inverting input, a resistor R1 through which the signal from the preceding stage is coupled to the inverting input of the amplifier, and a resistor R2 connected between the non-inverting input and the junction of resistors 50, 58 and 59. The R1 and R2 resistors typically have resistance values of 1.5 Kohms and 10 Kohms, respectively, and capacitor C typically has a value of 0.047 microfarads. The output of integrators 54 is applied as positive feedback to the non-inverting input of amplifier 48 via a resistor 51, and the output of integrator 56 is applied as negative feedback to the inverting input of amplifier 48 via a resistor 52. The output of amplifier 48 is applied to the input of a bilateral switch 64 connected in series with resistor R1 of integrator 54 and the output of integrator 54 is applied to the input of a second bilateral switch 65, connected in series with resistor R1 of integrator 56. Switches 64 and 65 preferably are two of the four switches contained in the Type 4016 quad-bilateral switch commercially available from RCA, Motorola and others, which utilizes P-channel and N-channel CMOS circuits to provide an extremely high "OFF" resistance and low "ON" resistance switch, which will pass signals in either direction. The "ON" resistance of this switch is about 300 ohms, considerably lower than the resistance of R1. The amplifiers forming the active elements of integrators 54 and 56 may be the two amplifiers contained in the Type 1458 dual operational amplifier commercially available in integrated circuit form. The described connections provide a filter having a low pass output at the output of the second integrator 56 and a rapid rate of rolloff, approximately 12 db per octave.

The integration time constant of integrators 54 and 56 (which are the same) is determined by the capacitance of capacitor C and the effective resistance of the series-connected resistor R1 and the bilateral switch, the resistance of which, in turn, is determined by the percentage of the time the switch is closed. That is, by turning the switches 64 and 65 "ON" and "OFF" at a rapid rate and varying the time "ON" versus the time "OFF", the effective resistance of the series combination can be varied, thereby to change the cutoff frequency of the filter. When switches 64 and 65 are "ON" the effective series resistance is very low, in the described embodiment typically 1.8 Kohms, and when the switches are "OFF" the resistance is very high. An increase in the time switches 64 and 65 are "ON" decreases the effective resistance, causing an increase in the cutoff frequency of the filter; conversely, a decrease in the time the switches are "ON" increases the effective resistance and lowers the cutoff frequency. Precise control over the time "ON" versus the time "OFF" is achieved by applying to both switches in parallel a sequence of pulses the width of which (i.e., the duty cycle) is varied in accordance with the organ voice selected by the instrumentalist.

To obtain the desired rolloff of about 24 db per octave, the output of the described filter is applied to another filter 68 of the same configuration, consisting of a summing input network 70, first and second integrators 71 and 72, a pair of bilateral switches 73 and 74 respectively connected in series with the integrating resistor R1 of integrators 71 and 72, and positive and negative feedback connections from the outputs of integrators 71 and 72 to the non-inverting and inverting inputs, respectively, of summing input network 70. The switches 73 and 74 are controlled by the same sequence of pulses as is applied to switches 64 and 65 of the first filter, and the output of the second filter, the level of which is controllable by a potentiometer 76, is coupled to the main voicing channel 28 of the organ system.

The circuit for generating the pulse width modulated pulses for controlling the filter is controlled by digital inputs applied to the four input lines of a four-line-to-sixteen-line decoder 80 by selective actuation of stop tablets labelled Post Horn, Trumpet, Trombone and French Horn, respectively. The decoder 80, which may be a Type 74154 commercially available in integrated circuit form from Texas Instruments, National Semiconductor and others, is operative to produce a signal on one of its sixteen output terminals corresponding to a binary code selected for application to the four input lines. More particularly, when, for example, the "Post Horn" stop tablet is actuated, a negative potential is applied via a resistor 82 to the base electrode of a transistor 84, the collector of which is connected through a resistor 88 to a +5 volts source, represented by terminal 86, and produces a "high" at the collector of the transistor for application to a respective input line of the decoder. The other three stop tablets are similarly connected to respective input lines of the decoder. The decoder 80 inverts a "high" at its input to produce a "low" at a selected output terminal, thus, in effect, functioning in inverse binary. That is, when no tabs are actuated, that is, a zero is applied to each of the inputs, a count of 15 appears at the output of the decoder. Accordingly, if only the Post Horn tablet is actuated, the binary input code is 0111, which corresponds to a binary count of seven. Similarly, if only the trumpet tablet 22 is actuated, the binary code at the input to the decoder is 1011, which corresponds to a binary count of thirteen. Thus, by actuation of one or more of the tablets in various combinations it is possible to obtain sixteen different input binary codes, each of which will correspond to a binary count associated with one of the sixteen output terminals of the decoder. In the disclosed embodiment, the code 0000 is not used, however, thus giving the system the capability of fifteen different useful combinations.

Decoder 80 is operative in response to application of a "high" to one or more of the four input terminals in accordance with a selected binary code to pull the "decoded" output terminal to ground, thereby to establish a voltage divider consisting of a resistor 90 and a selected one of sixteen resistors having differing resistance values, one of which is labelled 92 and is connected through a diode 94 to one output terminal of the decoder, which voltage dividing network is connected between a +5 volts source, represented by terminal 96, and D.C. ground. The common junction of resistor 90 and the fifteen resistors (only one of which is selected by the decoder at a time) is connected to the base electrode of a transistor 98, connected as an emitter follower, which transfers the D.C. voltage level determined by the voltage divider to the emitter electrode of a PNP transistor 100, the collector of which is connected through a resistor 102 to the plus input of a comparator 104, which may be one-half of an LM339 comparator commercially available in integrated chip form. The magnitude of the D.C. voltage level applied to transistor 100 is different for each of the resistors connected to the output terminals of decoder 80 and, as has been described, is determined by the binary coded information defined by which of the four stop tablets are activated. The collector of transistor 100 is also connected to D.C. ground through a resistor 106, and the plus input to comparator 104 is connected to ground via a capacitor 108, and to the collector of transistor 100 through a diode 110. The output terminal of comparator 104 is connected through a resistor 138 to a +15 volts source of potential, and via line 139 to the four bilateral switches of the filters. As will presently be seen, transistor 100 adjusts the current applied to the plus input of comparator 104 in accordance with the D.C. voltage level established by the selected voltage dividing network. Thus, the value of the applied current is incrementally varied according to a binary weighting determined by selection of a particular organ voice.

The pulse width modulated pulses for application to the filter are obtained by comparing the current applied to comparator 104 with a sawtooth voltage applied to the minus input of comparator 104. The sawtooth voltage is generated by an oscillator which includes a second comparator 112, the output terminal of which is connected to the base electrode of a transistor 130; the emitter is connected to ground, and also via a resistor 140 to a +15 volts potential source, represented by terminal 142. The collector of transistor 130 is connected to the junction of a resistor 132 and a capacitor 134 serially connected between a +15 volts source of potential represented by terminal 136, and ground. The capacitor 134 is charged through resistor 132 from the +15 volts source, and at predetermined times (to be described) transistor 130 conducts and discharges capacitor 134 to zero potential and thereafter allows the capacitor to again be charged through the resistor. A reference potential determined by a pair of diodes 114 and 116 and a resistor 118 connected in series between a +5 volts source, represented by terminal 120, and ground, is applied from the junction of diode 116 and resistor 118 to the minus input of comparator 112 through a resistor 122; the resistor 122 provides isolation to prevent loading at the reference voltage point. The ramp of the sawtooth waveform voltage developed across capacitor 134 is sensed by the plus input of comparator 112 through a resistor 128. When the ramp voltage exceeds the reference voltage at the minus terminal of comparator 112 the output goes positive, causing transistor 130 to saturate and thereby discharge capacitor 134. Upon discharge of capacitor 134, the output of comparator 112 goes "low" because the potential at its plus terminal is lower than the reference voltage at its minus terminal and the capacitor 134 again charges through resistor 132, and the process is repeated. The resulting oscillatory sawtooth voltage signal 135, typically having a frequency of about 200 KHz, is coupled through a resistor 124 and a capacitor 126 connected in parallel therewith to the minus input of comparator 104; capacitor 126 is provided to keep the descending portion of the sawtooth waveform straight and "clean" so as to prevent any loading effect on the integrators in the filters. The frequency of the sawtooth signal is not critical, and may be as low as about 50 KHz.

The sawtooth voltage signal 135 developed at the junction of resistor 132 and capacitor 134, which has a positive- going ramp, is applied to the minus input terminal of comparator 104; comparator 104 has an output which is high as long as the plus input is greater than the minus input. If, for example, the plus terminal is at a level 148, to be in a positive region of the ramp voltage 135, relatively narrow pulses 146 are produced at the output of the comparator. When the level of the plus input is in a still more positive aea of the ramp, illustrated at 148', wider pulses 147 are produced at the output of the comparator. In both cases, the leading edge of the output pulses is coincident with the leading edge of the sawtooth waveform so as to provide the important advantage that the frequency of the output pulses is the same as the frequency of the sawtooth voltage signal and thus substantially constant. The performance is superior to that achieved by comparison of the level at the plus input with a triangular waveform signal, for example, where because the pulse width of the comparator output is a function of the intersection of both the up and down ramps with the sum voltage, there is a variation in phase, as well as pulse width, of the output pulses from the comparator, which phase change results in the generation of unwanted audio by-products in the filters. In the present system, then, the width of the pulses in the sequence appearing at the output of comparator 104 are width modulated only at the trailing edge thereof. The larger the voltage at the collector of transistor 100, the larger is the current applied to the plus input of comparator 104, causing the threshold to rise higher on the ascending ramp of the sawtooth waveform to produce a relatively wide pulse, the width being the projection on the time axis of the leading edge of the sawtooth voltage and the point of intersection of the threshold level with the ascending ramp. When the threshold intersects the ascending ramp at a lower level the resulting pulses are narrower, thereby decreasing the time that bilateral switches 64, 65, 73 and 74 in the filter are "ON", thus increasing the effective time constant resistance of each of the integrators and lowering the cutoff frequency of the filter.

Reverting now to the function of transistor 100, this transistor cannot conduct and apply current to the plus input of comparator 104 until it is enabled; this is accomplished by applying a potential to the base electrode thereof when a key of the organ is played. This is achieved by application of either a solo keyfeed signal or a solo key-sense signal generated in response to actuation of a solo key. In the case of the former, the signal is applied to the base electrode of a PNP transistor 150, the emitter of which is connected to a +15 volts source and through a resistor 152 to the base electrode, and the collector of which is connected via a resistor 154 to D.C. ground. The signal developed across resistor 154, in response to either a solo keyfeed signal or a solo keysense signal, is applied through a diode 156 to the junction of a resistor 158 and a capacitor 160 connected in series between the base electrode of a transistor 162 and ground. The potential applied to the junction of resistor 158 and capacitor 160 turns on transistor 162 at a rate determined by the time constant of capacitor 160 and resistor 158. Conduction of transistor 162 turns on transistor 100, causing a portion of the voltage at the emitter of transistor 98, determined by the voltage dividing action of a pair of resistors 164 and 166, to be transferred to the collector of transistor 100 and to charge capacitor 108 through resistor 102. Thus, resistor 102 and capacitor 108 determine the attack time constant.

Figure 3:
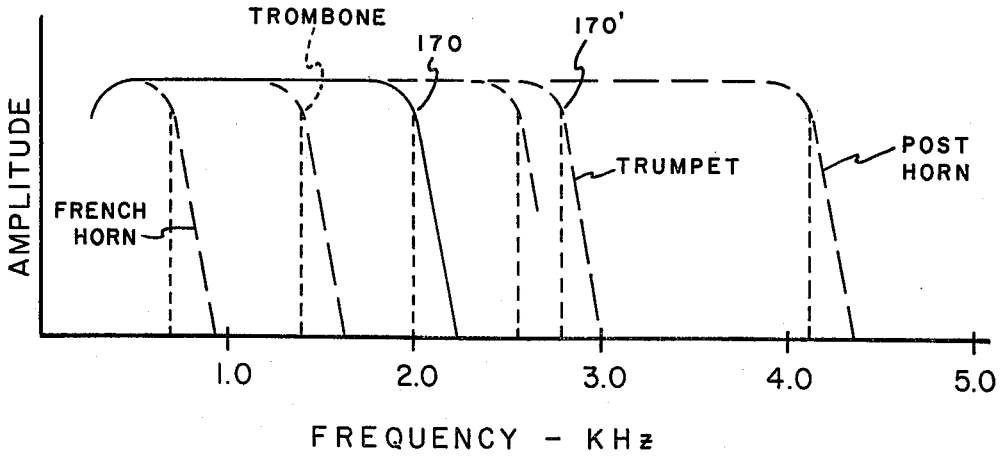
FIG. 3 is a diagram showing the approximate filter characteristics of the filter of FIG. 2.

The filter 16 ideally has characteristics as shown in FIG. 3, being essentially flat up to a cut-off frequency, having a sharp knee 170 at the cut-off frequency and a high rate of attenuation, at least 24 db per octave for frequencies above the cut-off frequency. If the filter is adjusted to cutoff at 2 KHz (the characteristic shown in solid line in which the cutoff frequency is measured at 3 db down), very little energy due to harmonics in the applied signal having frequencies above 2 KHz is transmitted by the filter. If, however, the cut-off frequency is adjusted so that the knee of the filter characteristic is at 170', namely, at 2.8 KHz, much more of the harmonic energy contained in the applied pulses is transmitted by the filter. Even relatively slight changes in the cutoff frequency change the flavor of the resulting sound signal to a marked degree, from very mellow to bright, starting with the French Horn at a cutoff frequency of about 636 Hz, and going through the Trombone at a cutoff frequency of about 1.38 KHz, the Trumpet at a cutoff frequency of about 2.56 KHz, to the Post Horn at a cutoff frequency of about 4.188 KHz. The cuttoff frequency of the filter is varied between predetermined limits by incrementally varying the current applied to transistor 100 the value of which, in turn, is varied according to the binary weighting determined by selective actuation of the stop tablets 20, 22, 24 and 26. The cutoff frequency at the lower end of the range of adjustment is determined by establishing a minimum duty cycle for the pulse width modulated control pulses, and the highest cutoff frequency in the range of adjustment is determined by control pulses having a 100% duty cycle.

Control of the switching duty cycle, and hence the cutoff frequency of the filter according to a binary weighting determined by a 4-bit code depending on which of the four input lines of decoder 80 are activated, gives the system the capability not only of synthesizing sounds simulative of the Post Horn, Trumpet, Trombone and French Horn, but to also produce up to eleven additional different sounds having tonal qualities similar to, yet not the same, as the named instruments. For example, if stop tablets 20 and 22 are both actuated (providing a binary coded input of 0011), the resulting sound has tonal qualities between those of the Post Horn and Trumpet. Similarly, if the Trombone and French Horn tablets are actuated, giving a coded input of 1100, the cutoff frequency of the filter is adjusted to a point to give an output sound signal having musical qualities between those of the Trombone and of the French Horn. Although the system has the capability of simulating fifteen instruments—not only the four named on the stop tablets—one would seldom use many of the possible "instruments" because of the confusion of the listener as to which instrument he is hearing; in other words, one would normally select those combinations of tabs that produce sounds having a relatively close relationship to the sounds of the instruments corresponding to the "on" tabs.

While the invention has been disclosed by means of a specific illustrative embodiment thereof, it will now be obvious to those skilled in the art that various modifications can be made without departing from the spirit of the invention as defined in the appended claims. For example, although a specific form of circuit is described for varying the duty cycle of the pulse width modulated pulses for controlling the cutoff frequency of the filter, other implementations are possible and will now be suggested to ones skilled in the art.

I claim:

1. In an electronic organ which includes:

a tone signal generating system for generating tone signals corresponding to notes in a musical scale; an output system for translating tone signals into audible musical tones; a keyboard having a plurality of keys, each identified with a particular note of the musical scale; and at least four stop tablets, each identified with a different organ voice; a circuit for synthesizing a selectable one of a plurality of different organ voices, comprising:

voltage controlled sharp cutoff low-pass filter circuit means connected to couple player-selectable tone signals from said tone signal generating system to said output system, said filter circuit means having a cutoff frequency controllable over a range between a first frequency and a second higher frequency in response to variations in the duty cycle of a control signal comprising a sequence of pulse width modulated pulses, and a rapid rate of roll-off above the cutoff frequency, means including said at least four stop tablets for generating responsively to player actuation of a selected one or more of said at least four stop tablets a selected one of a plurality of different actuating signals each of which is associated with one and only one of said plurality of organ voices and each of which is uniquely identified by one of a plurality of different 4-bit binary words selectable in accordance with which one or more of said at least four stop tablets are actuated, and control signal generator means for applying a sequence of pulse width modulated pulses to said filter circuit means, said control signal generator means including means responsive to a selected actuating signal for controlling the width of said pulses to cause said filter circuit means to have a cutoff frequency appropriate to the tone quality of the organ voice determined by the stop tablets actuated by the player.

2. Apparatus in accordance with claim 1, wherein said means for generating said actuating signals comprises means for generating a plurality of different discrete voltage levels each uniquely associated with one of said 4-bit binary words, and wherein said control signal generator means comprises:

means for generating a sawtooth waveform voltage of predetermined frequency, comparator means having a pair of input terminals and an output terminal, means for applying said sawtooth waveform voltage to one input terminal of said comparator, and means for applying a selected discrete voltage level to the other input terminal of said comparator, said comparator being operative to produce a sequence of pulse width modulated pulses having a pulse repetition rate corresponding to the frequency of said sawtooth waveform voltage and a width corresponding to the coincident level of said selected discrete voltage level with respect to said sawtooth waveform voltage.

3. Apparatus in accordance with claim 2, wherein said means for generating said plurality of different discrete voltage levels comprises:

binary decoder means having at least four input terminals each connected to a respective one of said at least four stop tablets and a second greater plurality of output terminals, means including said at least four stop tablets for applying activating signals to one or more of the input terminals of said binary decoder means in accordance with which one or more of said at least four stop tablets are actuated, a plurality of resistors having differing resistance values connected one each to a respective output terminal of said binary decoder means and each connected in series with a common resistor to provide a like plurality of different voltage dividing networks, said binary decoder means being responsive to said activating signals to connect in circuit with a source of voltage the appropriate voltage dividing network for generating the discrete voltage level uniquely associated with the selected organ voice, and means for applying said generated discrete voltage level to said comparator means.

4. Apparatus in accordance with claim 3, wherein said filter circuit means comprises at least one state variable filter having two integrators connected in a loop with a summing input network, the integrating time constant of each of said integrators being determined by a capacitor and a resistive network comprising a resistor connected in series with a bilateral switch having a much higher resistance when off than when on, and means for applying said sequence of pulse width modulated pulses to said bilateral switch for varying the time on versus the time off of said switch and the effective resistance value of said resistive network, for varying the cutoff frequency of said filter.

5. In an electronic organ which includes tone signal generating means for generating tone signals corresponding to notes in a musical scale; an output system for translating tone signals into audible musical tones; a keyboard having a plurality of keys, each identified with a particular note of the musical scale; and at least four stop tablets, each identified with a different organ voice; a system for synthesizing a selectable one of a plurality of different organ voices, comprising:

voltage controlled sharp cutoff low-pass filter circuit means connected to couple player-selectable tone signals from said tone signal generating means to said output system, said filter circuit means including cascade-connected state variable filters each having two integrators connected in a loop with a summing network, the integrating time constant of each of said integrators being substantially the same and determined by a capacitor and a resistive network including a bilateral switch having a much higher resistance when off than when on, said filter circuit means having a cutoff frequency controllable over a range between a first frequency and a second higher frequency in response to variations in the duty cycle of a sequence of pulse width modulated pulses supplied to said bilateral switches for turning them on and off in unison at a high rate, and having a rapid rate of roll-off above the cutoff frequency, means including said at least four stop tablets for generating responsively to player actuation of a selected one or more of said at least four stop tablets a selected one of a plurality of different actuating signals each of which is associated with one and only one of said plurality of organ voices and each of which is uniquely identified by one of a plurality of different 4-bit binary words selectable in accordance with which one or more of said at least four stop tablets are actuated, and control signal generator means for generating and applying to the said bilateral switches included in said filter circuit means a sequence of pulse width modulated pulses the width of which pulses are controlled in accordance with the 4-bit binary word selected by player actuation of said at least four stop tablets for causing said filter circuit means to have a cutoff frequency appropriate to the tone quality of the selected organ voice.

6. Apparatus according to claim 5, wherein said actuating signal generating means comprises means for generating a plurality of different discrete voltage levels each uniquely associated with one and only one of said organ voices, and wherein said control signal generator means comprises:

oscillator means for generating a sawtooth voltage signal having a leading edge and a ramp and a predetermined frequency, and comparator means for comparing a selected discrete voltage level with said sawtooth waveform voltage for producing a sequence of pulses having said predetermined frequency and a width corresponding to the coincident level of said selected discrete voltage level with respect to the ramp of said sawtooth voltage signal.

7. Apparatus in accordance with claim 6, wherein the leading edge of the pulses of said sequence is substantially time coincident with the leading edge of said sawtooth voltage signal.

8. Apparatus in accordance with claim 6 or claim 7, wherein said discrete voltage level generating means comprises:

a four line-to-sixteen line binary decoder having four input terminals coupled to a respective one of said at least four stop tablets and a plurality of output terminals, a plurality of resistors of differing resistance values connected one each to a respective output terminal of said decoder and each connected in series with a common resistor to provide a like plurality of different voltage dividing networks, said binary decoder being responsive to activating signals applied to selected input terminals thereof in response to player-actuation of one or more of said at least four stop tablets to connect a voltage dividing network corresponding to a selected organ voice in circuit with a source of voltage for producing the discrete voltage level uniquely associated with the selected organ voice, and means for applying said generated voltage level to said comparator means.

* * * * *